US009481169B2

(12) United States Patent
Domae

(10) Patent No.: US 9,481,169 B2
(45) Date of Patent: Nov. 1, 2016

(54) LIQUID JET HEAD AND LIQUID JET APPARATUS

(71) Applicant: SII PRINTEK INC., Chiba-shi, Chiba (JP)

(72) Inventor: Yoshinori Domae, Chiba (JP)

(73) Assignee: SII PRINTEK INC. (JP)

( * ) Notice: Subject to any disclaimer, the term of this patent is extended or adjusted under 35 U.S.C. 154(b) by 0 days.

(21) Appl. No.: 14/644,270

(22) Filed: Mar. 11, 2015

(65) Prior Publication Data

US 2015/0258781 A1 Sep. 17, 2015

(30) Foreign Application Priority Data

Mar. 12, 2014 (JP) ..... 2014-049366

(51) Int. Cl.

*B41J 29/38* (2006.01)
*B41J 2/045* (2006.01)
*B41J 2/14* (2006.01)

(52) U.S. Cl.

CPC ..... *B41J 2/04588* (2013.01); *B41J 2/04581* (2013.01); *B41J 2/14209* (2013.01); *B41J 2202/08* (2013.01); *B41J 2202/12* (2013.01)

(58) Field of Classification Search

CPC .. B41J 2/04581; B41J 2/3358; B41J 2/1408; B41J 2/04501; B41J 2/30; B41J 29/377; B41J 2002/08
USPC ..... 347/10, 18
See application file for complete search history.

(56) References Cited

U.S. PATENT DOCUMENTS 5,017,941 A * 5/1991 Drake ..... 347/67
6,315,403 B1 * 11/2001 Shinozaki ..... B41J 2/005 347/100
8,220,906 B2 * 7/2012 Ito ..... 347/71
2003/0133492 A1 * 7/2003 Watanabe ..... 374/179
2006/0050098 A1 * 3/2006 Kim ..... 347/18
2009/0085950 A1 * 4/2009 Takata ..... 347/18
2009/0141063 A1 * 6/2009 Takano et al. ..... 347/18
2010/0013893 A1 * 1/2010 Akahane ..... 347/65
2013/0010019 A1 * 1/2013 Shirato ..... 347/10

FOREIGN PATENT DOCUMENTS

EP 2028012 2/2009
GB 2504777 2/2014
JP 2005279952 10/2005
JP 2006212795 8/2006
WO WO 0077475 A1 * 12/2000 ..... B41J 1/00
WO 2014021812 2/2014

OTHER PUBLICATIONS

European Search Report mailed Aug. 21, 2015 issued in Appln. No. EP 15 15 8733.

* cited by examiner

*Primary Examiner* — Julian Huffman
*Assistant Examiner* — Sharon A Polk
(74) *Attorney, Agent, or Firm* — Adams & Wilks

(57) ABSTRACT

A liquid jet head includes a head portion having a supply flow path configured to allow liquid supplied from the outside to flow therethrough, a pressure chamber that communicates with the supply flow path, a driver element that drives the pressure chamber, and a nozzle that communicates with the pressure chamber for ejecting liquid droplets. A circuit portion supplies a drive waveform to the driver element. A cooling portion has a cooling flow path configured to allow the liquid to flow therethrough, and the cooling portion is coupled and fixed to the circuit portion to absorb heat energy dissipated by the circuit portion. The supply flow path and the cooling flow path communicate with each other so that the same liquid flows through both paths thereby eliminating the need for a dedicated cooling liquid system and achieving size and cost reduction.

12 Claims, 8 Drawing Sheets

LIQUID JET HEAD AND LIQUID JET APPARATUS

BACKGROUND

1. Technical Field

The present invention relates to a liquid jet head which jets liquid droplets onto a recording medium to perform recording and a liquid jet apparatus.

2. Related Art

In recent years, there has been used a liquid jet head of an ink jet system which ejects ink droplets onto, for example, recording paper to record characters or figures thereon, or ejects a liquid material onto the surface of an element substrate to form a functional thin film thereon. In this ink jet system, liquid such as ink and a liquid material is guided from a liquid tank into a channel through a supply tube, and pressure is applied to the liquid filled in the channel to thereby eject the liquid as liquid droplets from a nozzle which communicates with the channel. In the ejection of liquid droplets, characters or figures are recorded, or a functional thin film having a predetermined shape or a three-dimensional structure is formed by moving the liquid jet head or a recording medium.

A liquid jet head of an ink jet system includes a pressure chamber to which liquid such as ink is introduced, a driver element which drives the pressure chamber, a drive circuit portion which generates a drive waveform and supplies the drive waveform to the driver element, a nozzle which communicates with the pressure chamber and ejects liquid inside the pressure chamber therefrom, and the like. In the driver element, there is used a system that generates pressure waves in liquid filled in the pressure chamber using a piezoelectric effect of a piezoelectric body and ejects liquid droplets by the pressure waves or a system that heats a heat generator provided in the pressure chamber to generate air bubbles in liquid filled in the pressure chamber and ejects liquid droplets by pressure waves generated along with the generation of the air bubbles. When driving the pressure chamber, the driver element itself generates heat and the drive circuit portion which generates a drive waveform also generates heat.

JP 2006-212795 A describes a configuration that performs cooling of a head portion in which a driver element using a piezoelectric body is formed and cooling of a drive circuit portion which generates a drive waveform. FIG. 8 is a perspective view of an ink jet printer head 105 described in JP 2006-212795 A. FIGS. 9A and 9B are explanatory diagrams of a temperature control base 151 for the ink jet printer head 105 described in JP 2006-212795 A. The ink jet printer head 105 is fixed onto the temperature control base 151 to cool a part of the inkjet printer head 105 required to be cooled. The ink jet printer head 105 mainly includes an ink ejecting portion 121 and a drive waveform generating portion 122. The ink ejecting portion 121 includes a PZT substrate 124 which is covered with a top plate 125 and a nozzle plate 126 which is fixed to the tip part of the ink ejecting portion 121. The PZT substrate 124 has a plurality of grooves (not illustrated) which are covered with the top plate 125 to constitute pressure chambers. Ink is supplied to the pressure chambers through an ink supply tube 127. The drive waveform generating portion 122 includes a circuit board 128 which is coupled to the ink ejecting portion 121. The circuit board 128 includes a first board 128*a* which is directly fixed to the ink ejecting portion 121 and a second board 128*b* which is coupled to the first board 128*a* and provided with a connector 130. A driver IC is disposed on the lower face of the first board 128*a*. When the driver IC generates a drive waveform and the generated drive waveform is applied to drive electrodes (not illustrated) which are formed on supports located on opposite sides of each of the pressure chambers, the supports are deformed by a piezoelectric effect and the volume of each of the grooves thereby changes. As a result, the ink filled in the pressure chambers is ejected from nozzles 123. As this point, the driver IC and the PZT substrate 124 generate heat.

The temperature control base 151 includes a first base 152 and a second base 153 which are coupled to each other through an adhesive layer 154. The temperature control base 151 is fixed to the lower part of the ink jet printer head 105. A structure base 151*a* is attached to the lower part of the temperature control base 151. The first base 152 is fixed to the ink ejecting portion 121 and cools the PZT substrate 124 of the ink ejecting portion 121. The second base 153 is fixed to the drive waveform generating portion 122 and heats the driver IC. The first base 152 is provided with a liquid circulation tube inside thereof. The liquid circulation tube of the first base 152 is coupled to two first coupling portions 155. The second base 153 is provided with a liquid circulation tube inside thereof. The liquid circulation tube of the second base 153 is coupled to two second coupling portions 156. Cooling liquid is circulated through the first coupling portions 155 and the second coupling portions 156 to thereby release heat to the outside. Water or oil is used as the cooling liquid.

JP 2005-279952 A describes a configuration that prevents deterioration of recording quality caused by a difference in temperature of ejection ink depending on nozzle installation locations. When a difference in temperature of ejection ink is generated depending on nozzle installation locations, the ejection characteristics change according to the difference in temperature of ink. Accordingly, the recording quality on a recording medium is deteriorated. Thus, an IC chip which generates a drive waveform for driving a head portion is coupled to a heat release member, and the heat release member is routed up to the vicinity of an ink supply member of the head portion. As a result, heat generated by the IC chip is transmitted through the heat release member and then released near the ink supply member. Ink in the ink supply member is heated by the released heat, thereby reducing temperature variations between various locations of ink.

The ink jet printer head 105 described in JP 2006-212795 A is capable of independently cooling the PZT substrate 124 and the circuit board 128. However, it is necessary to connect the ink supply tube 127 for supplying ink to the head portion, two outgoing and return cooling tubes for cooling the PZT substrate 124, and two outgoing and return cooling tubes for cooling the circuit board 128 to the ink jet printer head 105. Thus, it is necessary to connect five liquid circulation tubes in total between the head portion and the control portion. Therefore, many components are required, and assembly thereof becomes complicated. JP 2005-279952 A describes the configuration which uses heat generated by the IC chip for driving the head portion. However, JP 2005-279952 A fails to describe a configuration and a method for efficiently cooling the IC drive chip.

SUMMARY

A liquid jet head according to the present invention includes: a head portion including a supply flow path configured to allow liquid supplied from the outside to flow therethrough, a pressure chamber communicating with the supply flow path, a driver element configured to drive the pressure chamber, and a nozzle communicating with the pressure chamber, the head portion being configured to eject liquid droplets through the nozzle; a circuit portion configured to supply a drive waveform to the driver element; and a cooling portion including a cooling flow path configured to allow the liquid to flow therethrough, the cooling portion being coupled and fixed to the circuit portion, wherein the liquid flows through the supply flow path and through the cooling flow path in parallel.

The liquid jet head further includes a supply port configured to allow the liquid supplied from the outside to flow in therethrough and a discharge port configured to discharge the liquid to the outside therethrough. The liquid flowing into the supply port is divided to flow into the supply flow path and the cooling flow path, and the liquid flowing out of the supply flow path and the liquid flowing out of the cooling flow path join together and the joined liquid is discharged to the outside through the discharge port.

The supply flow path includes a first supply flow path and a second supply flow path. The liquid flowing into the supply port is divided to flow into the first supply flow path, the second supply flow path, and the cooling flow path. The liquid flowing out of the first supply flow path, the liquid flowing out of the second supply flow path, and the liquid flowing out of the cooling flow path join together and the joined liquid is discharged to the outside through the discharge port.

The liquid jet head further includes a branch point at which the liquid is divided to flow into the first supply flow path and the second supply flow path. A flow path resistance between the branch point and the first supply flow path is equal to a flow path resistance between the branch point and the second supply flow path.

The liquid jet head further includes a junction point at which the liquid flowing out of the first supply flow path and the liquid flowing out of the second supply flow path join together. A flow path resistance between the junction point and the first supply flow path is equal to a flow path resistance between the junction point and the second supply flow path.

The circuit portion includes a driver IC configured to generate the drive waveform and a circuit board on which the driver IC is mounted. The cooling portion includes a cooling substrate having the cooling flow path formed inside thereof. The circuit board and the cooling substrate are coupled and fixed to each other with substrate surfaces facing each other.

The circuit board and the cooling substrate are coupled and fixed to each other with a heat release sheet interposed therebetween.

The circuit board includes a first circuit board and a second circuit board. The first circuit board is coupled and fixed to one substrate surface of the cooling substrate. The second circuit board is coupled and fixed to the other substrate surface of the cooling substrate.

The cooling flow path has a cross-sectional shape in which the width in a direction parallel to the substrate surfaces of the cooling substrate is wider than the width in a direction perpendicular to the substrate surfaces of the cooling substrate.

The cooling flow path meanders within a plane parallel to the substrate surfaces of the cooling substrate.

The driver IC is disposed corresponding to the cooling flow path.

The cooling flow path is divided into a plurality of flow paths on an upstream side and the plurality of flow paths join together on a downstream side.

A liquid jet apparatus of the present invention includes the liquid jet head described above, a movement mechanism configured to relatively move the liquid jet head and a recording medium, a liquid supply tube configured to supply the liquid to the liquid jet head, and a liquid tank configured to supply the liquid to the liquid supply tube.

EFFECT OF INVENTION

The liquid jet head according to the present invention includes: a head portion including a supply flow path configured to allow liquid supplied from the outside to flow therethrough, a pressure chamber communicating with the supply flow path, a driver element configured to drive the pressure chamber, and a nozzle communicating with the pressure chamber, the head portion being configured to eject liquid droplets through the nozzle; a circuit portion configured to supply a drive waveform to the driver element; and a cooling portion including a cooling flow path configured to allow the liquid to flow therethrough, the cooling portion being coupled and fixed to the circuit portion, wherein the liquid flows through the supply flow path and through the cooling flow path in parallel. Accordingly, it is possible to efficiently cool the circuit portion without using cooling liquid other than the liquid for ejection and to simplify the connection with an apparatus in which the liquid jet head is installed.

DETAILED DESCRIPTION

First Embodiment

Figure 1:
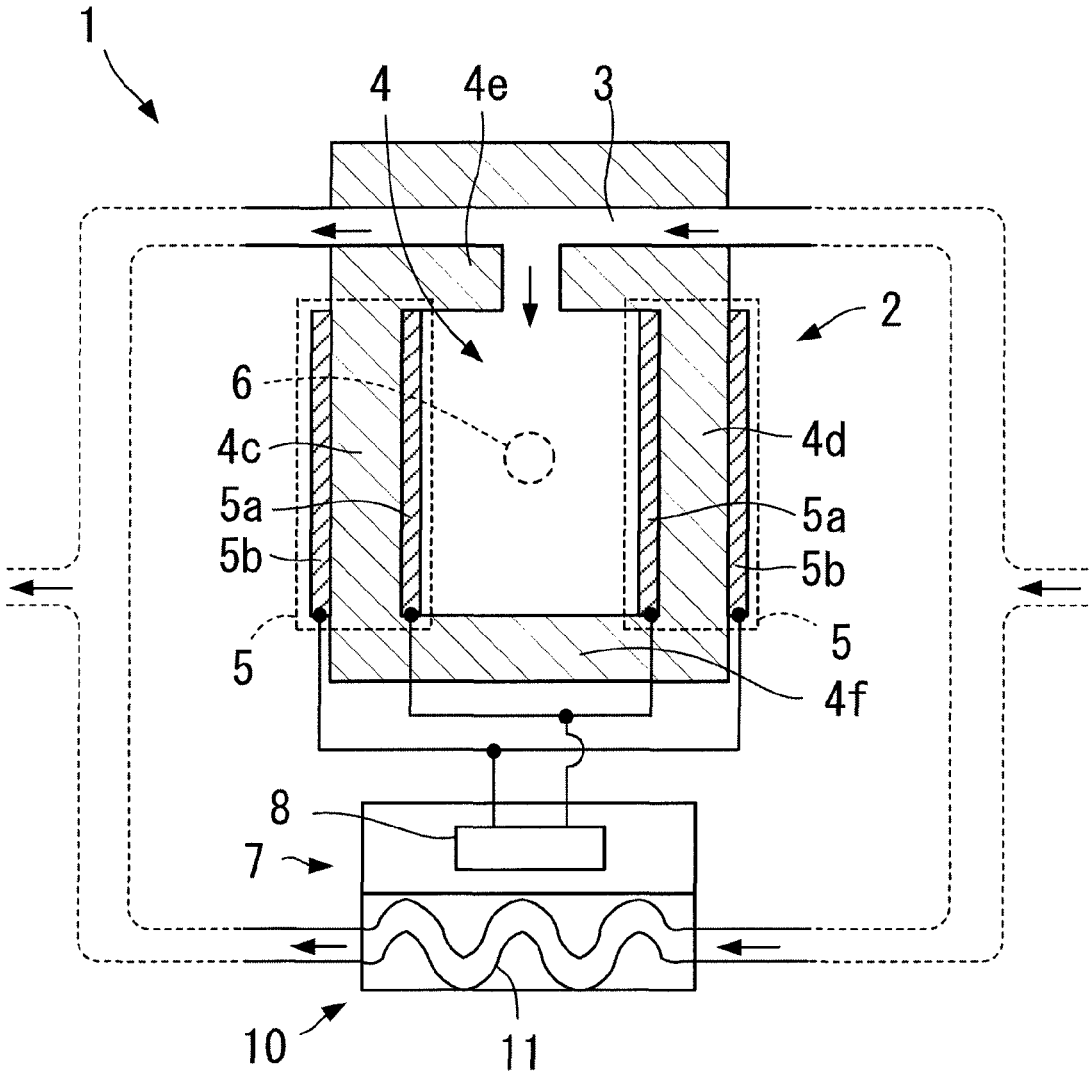
FIG. 1 is a schematic view of a liquid jet head according to a first embodiment of the present invention.

FIG. 1 is a schematic view of a liquid jet head 1 according to a first embodiment of the present invention. The first embodiment shows a basic configuration of the present invention. As illustrated in FIG. 1, the liquid jet head 1 is provided with a head portion 2 which ejects liquid droplets from a nozzle 6, a circuit portion 7 which supplies a drive waveform to the head portion 2, and a cooling portion 10 which is coupled and fixed to the circuit portion 7. The head portion 2 includes a supply flow path 3 which allows part of the liquid supplied from the outside to flow therein, to flow through the inside thereof, and to flow out to the outside therefrom, a pressure chamber 4 which communicates with the supply flow path 3, a driver element 5 which drives the pressure chamber 4, and the nozzle 6 which communicates with the pressure chamber 4. The circuit portion 7 generates a drive waveform for driving the driver element 5 of the head portion 2. The cooling portion 10 includes a cooling flow path 11 which allows part of the rest part or the entire rest part of the liquid supplied from the outside to flow therein, to flow through the inside thereof, and to flow out to the outside therefrom. Thus, the liquid flows through the supply flow path 3 and through the cooling flow path 11 in parallel.

For example, the pressure chamber 4 is surrounded by left and right side walls 4*c* and 4*d* each of which is made of a piezoelectric material such as PZT ceramics and upper and lower side walls 4*e* and 4*f* each of which is made of a piezoelectric material or a non-piezoelectric material. The pressure chamber 4 communicates with the supply flow path 3 and the nozzle 6. The driver element 5 includes the left and right side walls 4*c* and 4*d* made of a piezoelectric material and drive electrodes 5*a* and 5*b* which are disposed on opposite side surfaces of each of the side walls 4*c* and 4*d*. The side walls 4*c* and 4*d* on each of which the drive electrodes 5*a* and 5*b* are disposed are previously polarized upward and downward from a position located at half the height thereof. The circuit portion 7 includes a driver IC 8 which generates a drive waveform for driving the driver element 5. Application of a drive waveform between the drive electrodes 5*a* which face the pressure chamber 4 and the respective drive electrodes 5*b* which are located opposite to the pressure chamber 4 causes thickness-shear deformation of the two side walls 4*c* and 4*d*, thereby changing the volume of the pressure chamber 4. Accordingly, liquid filled in the pressure chamber 4 is ejected from the nozzle 6. When the liquid in the pressure chamber 4 has been consumed, liquid is supplied through the supply flow path 3. A piezoelectric material such as PZT ceramics or another insulating material may be used as the upper and lower side walls 4*e* and 4*f*.

The driver IC 8 generates heat when the drive waveform is supplied to the driver element 5. The heat generated by the driver IC 8 of the circuit portion 7 is transmitted to the cooling flow path 11 of the cooling portion 10 so as to be transmitted to liquid flowing through the cooling flow path 11, and then released to the outside. Thus, the liquid supplied from the outside flows through the cooling flow path 11 and through the supply flow path 3 in parallel. Therefore, it is possible to control the pressure of liquid flowing through the supply flow path 3 with higher accuracy than when the liquid flows through the cooling flow path 11 of the cooling portion 10 and through the supply flow path 3 of the head portion 2 in series. Specifically, it becomes easy to control a meniscus formed on an opening of the nozzle 6. Further, the liquid is used for both cooling and ejection. Thus, it is possible to simplify the configuration of an apparatus in which the liquid jet head 1 is installed. That is, it is not necessary to use liquid dedicated for cooling and to provide a tube and a liquid feed or suction pump dedicated for cooling. In addition, since liquid flows through the supply flow path 3, it is possible to stabilize the temperature of the head portion 2.

The drive electrodes 5*a* and 5*b* may be formed up to half the height of the side walls 4*c* and 4*d* of the pressure chamber 4, and the side walls 4*c* and 4*d* may be previously uniformly polarized upward or downward. Further, another driver element that differs from the driver element 5 of the present embodiment may be used. For example, a driver element which is composed of a heat generator may be disposed inside the pressure chamber 4, the heat generator may be heated to generate air bubbles in liquid inside the pressure chamber 4, and liquid droplets may be ejected by pressure waves generated along with the generation of the air bubbles. Further, as the driver element 5, a piezoelectric body polarized in the thickness direction may be disposed outside the side walls 4*c* and 4*d*, and the side walls 4*c* and 4*d* may be deformed by driving the piezoelectric body to change the volume of the pressure chamber 4. In the present embodiment, the supply flow path 3 of the head portion 2 allows part of the liquid supplied from the outside to flow therein, to flow through the inside thereof, and to flow out to the outside therefrom. Instead of this, the supply flow path 3 of the head portion 2 may allow part of the liquid supplied from the outside to flow therein, and supply the liquid flowed therein to the pressure chamber 4 without allowing the liquid to flow out to the outside therefrom. That is, the supply flow path 3 of the head portion 2 is used only for circulation of liquid to be ejected.

Second Embodiment

Figure 2:
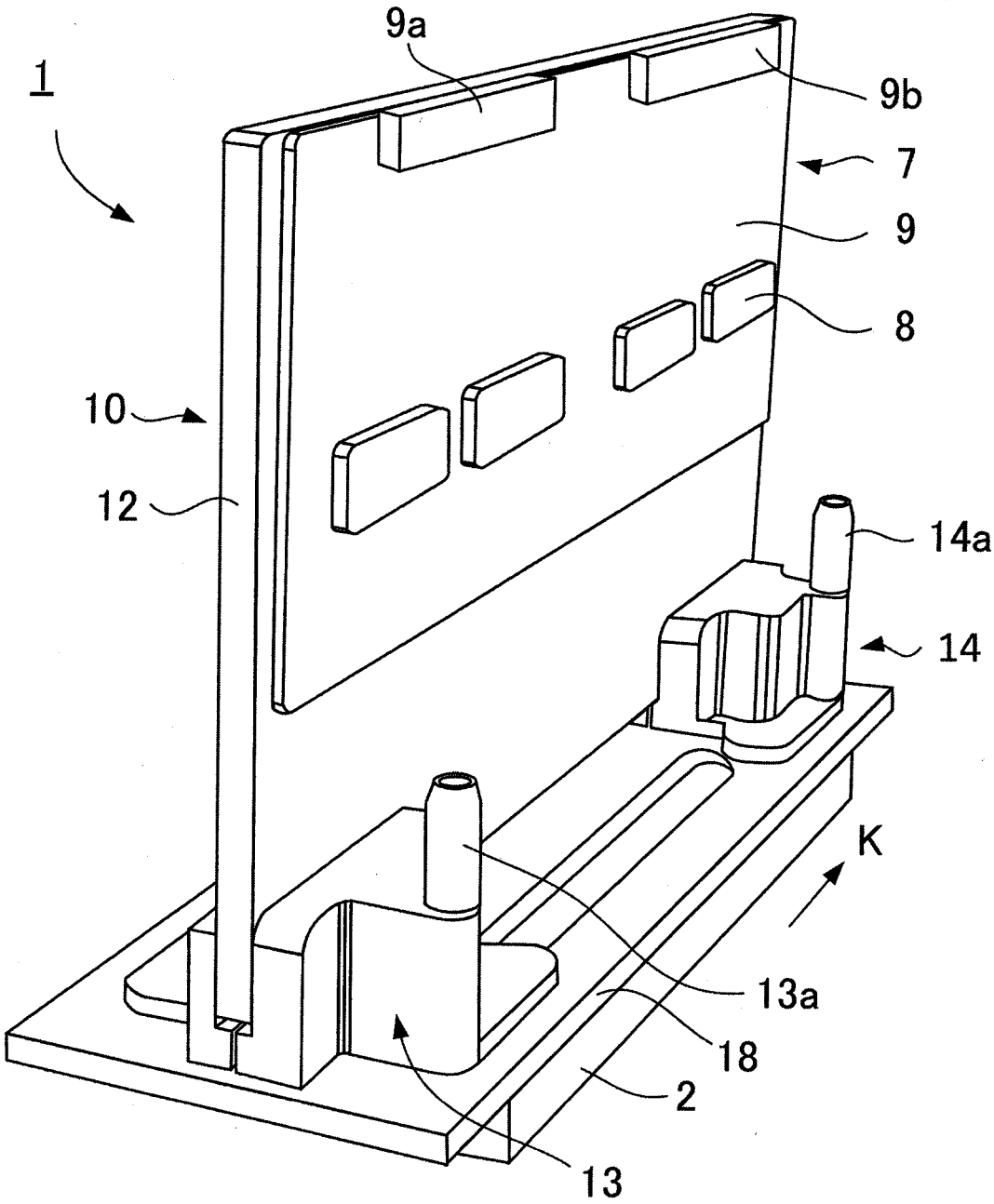
FIG. 2 is a schematic perspective view of a liquid jet head according to a second embodiment of the present invention.
Figure 3A:
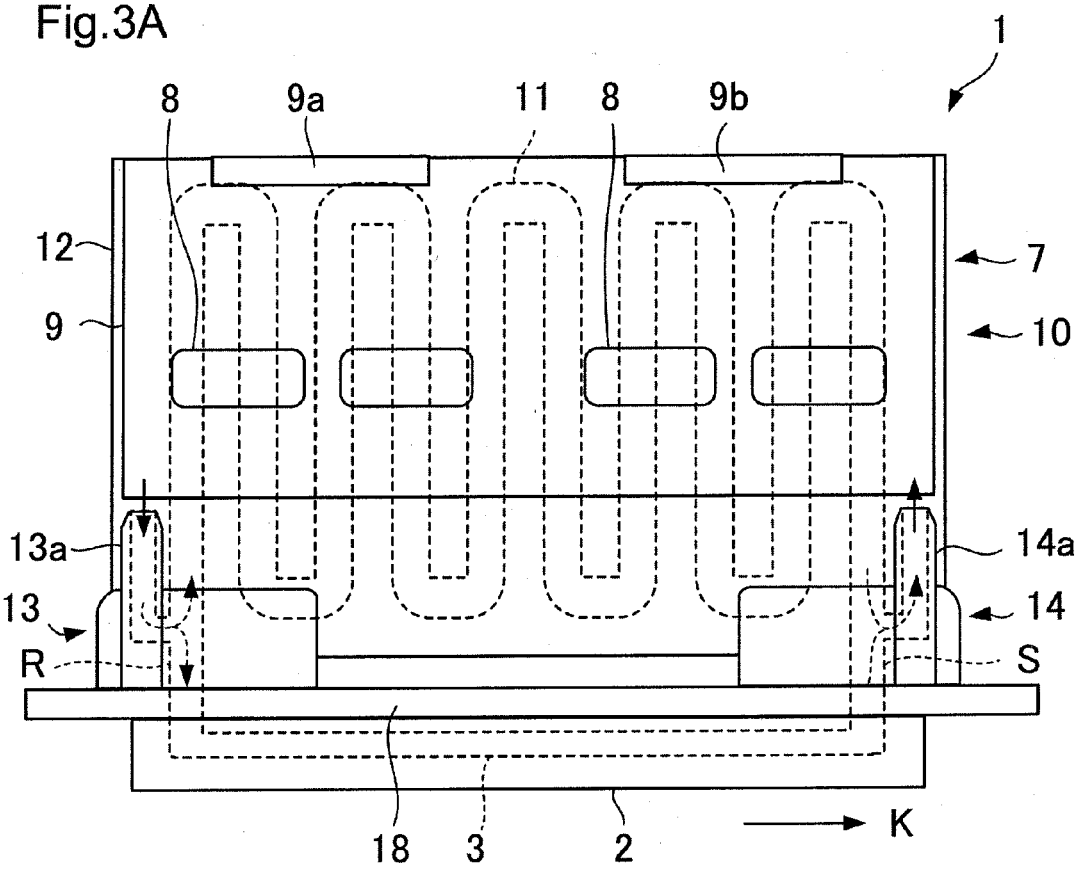
FIGS. 3A to 3C are explanatory diagrams of the liquid jet head according to the second embodiment of the present invention.
Figure 3B:
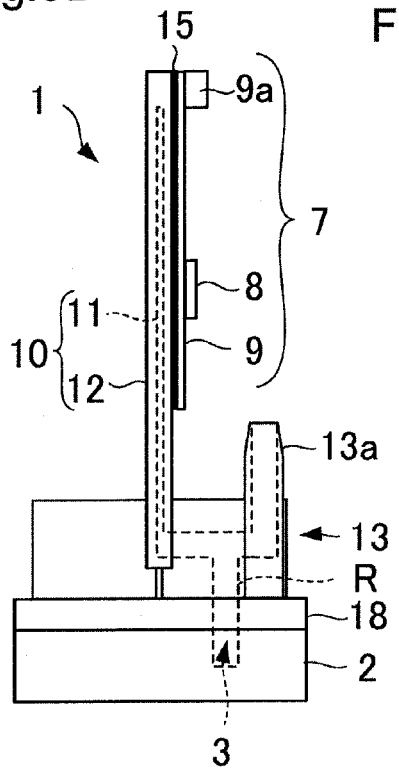
Figure 3C:
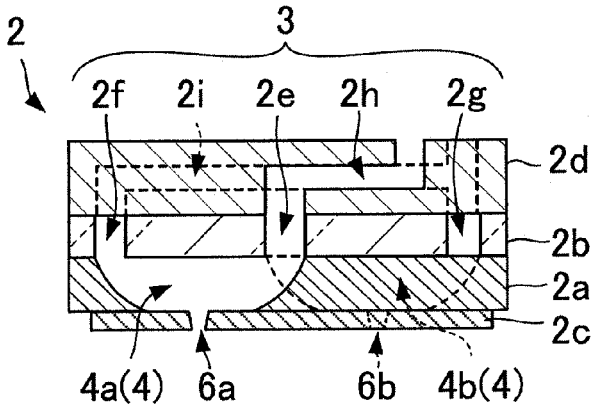

FIG. 2 is a schematic perspective view of a liquid jet head 1 according to a second embodiment of the present invention. FIGS. 3A to 3C are explanatory diagrams of the liquid jet head 1 according to the second embodiment of the present invention. FIG. 3A is a schematic front view of the liquid jet head 1 illustrating a cooling portion 10 viewed from the front side. FIG. 3B is a schematic side view of the liquid jet head 1 illustrating the cooling portion 10 and a circuit portion 7 viewed from the lateral side. FIG. 3C is a schematic cross-sectional view of a head portion 2 in a direction perpendicular to a reference direction K. Identical elements or elements having identical functions will be designated by the same reference numerals.

As illustrated in FIGS. 2 and 3A to 3C, the liquid jet head 1 is provided with the head portion 2 which ejects liquid droplets downward, a base member 18 to which the head portion 2 is fixed, a supply port 13 and a discharge port 14 each of which is disposed on the base member 18 on the opposite side of the head portion 2, the cooling portion 10 which is fixed to the supply port 13 and the discharge port 14 and stands on the opposite side of the head portion 2, and the circuit portion 7 which is coupled and fixed to the cooling portion 10. The circuit portion 7 includes a driver IC 8 which generates a drive waveform, a circuit board 9 on which the driver IC 8 is mounted, connectors 9*a* and 9*b* which input and output data such as a drive signal, an electrode terminal (not illustrated) for outputting the drive waveform. The cooling portion 10 includes a cooling substrate 12 which has a cooling flow path 11 formed inside thereof. The circuit board 9 and the cooling substrate 12 are coupled and fixed to each other with a heat release sheet 15 which is composed of a thermally conductive silicone paste or sheet interposed therebetween as well as with substrate surfaces facing each other. Specifically, the cooling substrate 12, the heat release sheet 15, and the circuit board 9 are formed in this order from the left side of FIG. 3B. The heat release sheet 15 is in contact with a surface of the circuit board 9, the surface being located opposite to a surface on which the connector 9*a* and the like are disposed. Further, a surface of the heat release sheet 15, the surface being located opposite to the surface that is in contact with the circuit board 9, is in contact with the cooling substrate 12. The cooling substrate 12 is fixed to the supply port 13 and the discharge port 14 with a space from the base member 18. Leaving a space between the base member 18 and the cooling substrate 12 prevents heat from the cooling substrate 12 from being transmitted to the head portion 2. The supply port 13 includes a connection portion 13*a*. The liquid supplied from the outside flows in through the connection portion 13*a*. The discharge port 14 includes a connection portion 14*a*. The liquid is discharged to the outside through the connection portion 14*a*.

As illustrated in FIG. 3C, the head portion 2 is provided with an actuator substrate 2*a*, a cover plate 2*b* which is bonded to the upper surface of the actuator substrate 2*a*, a flow path member 2*d* which is bonded to the upper surface of the cover plate 2*b*, and a nozzle plate 2*c* which is bonded to the lower surface of the actuator substrate 2*a*. The actuator substrate 2*a* is composed of, for example, a piezoelectric substrate made of PZT ceramics. The actuator substrate 2*a* is provided with pressure chambers 4*a* and 4*b* each of which is elongated in the direction perpendicular to the reference direction K. The left and right pressure chambers 4*a* and 4*b* are arranged in parallel to each other and displaced by a half pitch with respect to each other in the reference direction K. Side walls which define each of the pressure chambers 4*a* and 4*b* function as a driver element together with drive electrodes (not illustrated) which are formed on the respective side walls and drive each of the pressure chambers 4*a* and 4*b*. The cover plate 2*b* is provided with a liquid chamber 2*e* which communicates with the right end of each of the pressure chambers 4*a* and the left end of each of the pressure chambers 4*b*, a liquid chamber 2*f* which communicates with the left end of each of the pressure chambers 4*a*, and a liquid chamber 2*g* which communicates with the right end of each of the pressure chambers 4*b*. An electrode terminal (not illustrated) which is electrically connected to the driver element is formed on the upper surface or the lower surface of the actuator substrate 2*a* or the upper surface of the cover plate 2*b*, and electrically connected to an electrode terminal (not illustrated) of the circuit board 9 through a flexible circuit board (not illustrated). In this manner, the drive waveform generated by the driver IC 8 can be transmitted to the driver element.

The flow path member 2*d* is provided with a communication flow path 2*h* which allows the central liquid chamber 2*e* to communicate with an inner flow path R of the supply port 13 and a communication flow path 2*i* which allows the left liquid chamber 2*f* and the right liquid chamber 2*g* to communicate with an inner flow path S of the discharge port 14. Thus, liquid flowing from the supply port 13 flows through a supply flow path 3 which includes the communication flow path 2*h*, the liquid chamber 2*e*, the pressure chambers 4*a*, 4*b*, the liquid chambers 2*f*, 2*g*, and the communication flow path 2*i* inside the head portion 2, and flows out to the discharge port 14. The communication flow path 2*h* and the communication flow path 2*i* are respectively formed on first and second ends in the reference direction K and spaced from each other in the reference direction K. The liquid chamber 2*e* communicates with the communication flow path 2*h* on the first end in the reference direction K and extends over the plurality of pressure chambers 4*a*, 4*b* in the sheet direction of the FIG. 3C (the direction along which the plurality of pressure chambers 4*a*, 4*b* are arrayed). The liquid chamber 2*f* communicates with the communication flow path 2*i* on the second end in the reference direction K 2 and extends over the plurality of pressure chambers 4*a* in the sheet direction of FIG. 3C. The liquid chamber 2*g* communicates with the communication flow path 2*i* on the second end in the reference direction K and extends over the plurality of pressure chambers 4*b* in the sheet direction of FIG. 3C.

The nozzle plate 2*c* is provided with left nozzles 6*a* which communicate with the respective left pressure chambers 4*a* and right nozzles 6*b* which communicate with the respective right pressure chambers 4*b*. That is, the nozzle plate 2*c* has two right and left nozzle arrays. The supply port 13 divides the liquid supplied from the outside to flow into the supply flow path 3 and the cooling flow path 11. The discharge port 14 allows liquid flowing out of the supply flow path 3 and liquid flowing out of the cooling flow path 11 to join together and discharges the joined liquid to the outside therefrom.

A good thermal conductor such as aluminum is preferably used as the cooling substrate 12. The cooling flow path 11 meanders within a plane parallel to the substrate surfaces of the cooling substrate 12. Accordingly, the contact area between the liquid and the cooling substrate 12 increases, thereby making it possible to improve the cooling efficiency. Further, when the cooling flow path 11 is a single smoothly meandering flow path, air bubbles are not likely to be mixed when liquid is filled into the flow path. In addition, it becomes easy to discharge the filled liquid. The cooling flow path 11 preferably has a cross-sectional shape in which the width in a direction parallel to the substrate surfaces of the cooling substrate 12 is wider than the width in a direction perpendicular to the substrate surfaces of the cooling substrate 12. This prevents an increase in the volume of the cooling substrate 12 and also increases the contact area between the liquid and the cooling substrate 12. Accordingly, it is possible to improve the cooling efficiency. A top plate and a bottom plate of the cooling flow path 11 which constitute the cooling substrate 12 preferably have a predetermined thickness, for example, a thickness of 0.5 mm or more to improve the thermal conductivity.

The driver IC 8 is preferably disposed corresponding to the cooling flow path 11. That is, the driver IC 8 is disposed to overlap the cooling flow path 11 in the normal direction of the cooling substrate 12. Accordingly, it is possible to promptly transmit the heat generated by the driver IC 8 to the liquid in the cooling flow path 11. The overlapping area between the cooling flow path 11 and the driver IC 8 is preferably as wide as possible. A thermal conductor which is in contact with the outer surface of the driver IC 8 may be fixed to the cooling substrate 12 to cool the driver IC 8 from both sides thereof.

In this manner, part of the liquid supplied from the outside is circulated through the supply flow path 3 of the head portion 2, and part of the rest part or the entire rest part of the liquid supplied from the outside is circulated through the cooling flow path 11 of the cooling portion 10. Thus, it is possible to efficiently cool the circuit portion 7 without using cooling liquid other than the liquid for ejection. Further, the liquid is used for both cooling and ejection. Thus, it is possible to simplify the configuration of an apparatus in which the liquid jet head 1 is installed. Further, the circuit board 9 and the cooling portion 10 stand on the opposite side of the liquid droplet ejecting direction. Thus, the installation area of the liquid jet head 1 is reduced, and it is therefore possible to arrange many liquid jet heads 1 with high density.

Third Embodiment

Figure 4A:
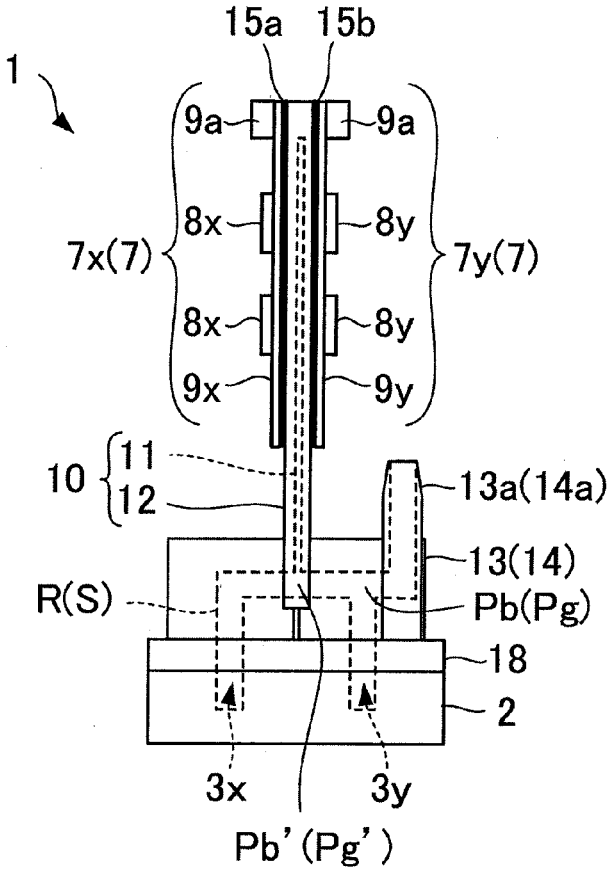
FIGS. 4A and 4B are explanatory diagrams of a liquid jet head according to a third embodiment of the present invention.
Figure 4B:
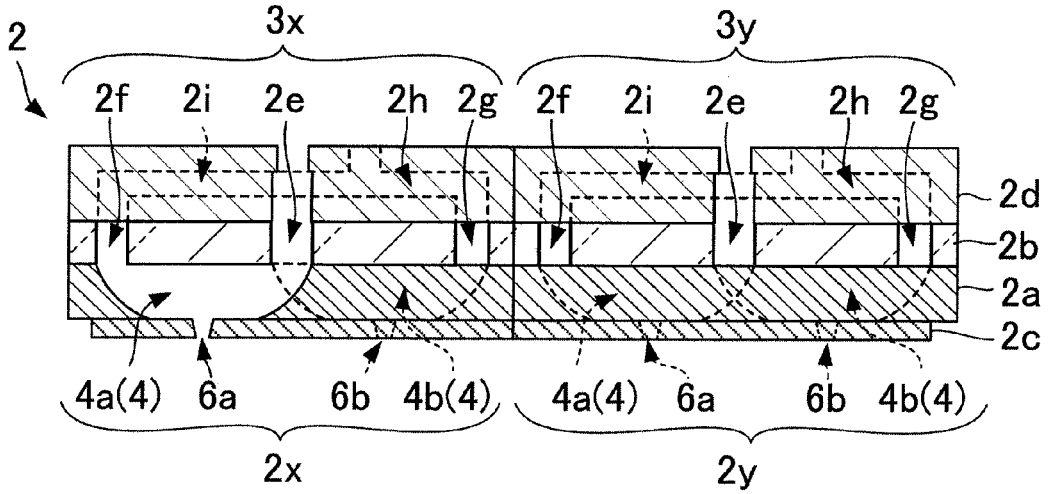

FIGS. 4A and 4B are explanatory diagrams of a liquid jet head 1 according to a third embodiment of the present invention. FIG. 4A is a schematic side view of the liquid jet head 1. FIG. 4B is a schematic cross-sectional view of a head portion 2 in a direction perpendicular to a reference direction K. The third embodiment differs from the second embodiment mainly in that a first circuit portion 7*x* and a second circuit portion 7*y* are coupled and fixed to a cooling portion 10, and the head portion 2 is provided with a first supply flow path 3*x* and a second supply flow path 3*y*. Identical elements or elements having identical functions will be designated by the same reference numerals.

As illustrated in FIGS. 4A and 4B, the liquid jet head 1 is provided with the head portion 2 which ejects liquid droplets downward, a base member 18 to which the head portion 2 is fixed, a supply port 13 and a discharge port 14 each of which is disposed on the base member 18 on the opposite side of the head portion 2, a cooling portion 10 which is fixed to the supply port 13 and the discharge port 14 and stands on the opposite side of the head portion 2, and the first circuit portion 7*x* and the second circuit portion 7*y* which are coupled and fixed to the cooling portion 10.

The cooling portion 10 includes a cooling substrate 12 which has a cooling flow path 11 formed inside thereof. As with the second embodiment, the cooling flow path 11 meanders within a plane parallel to the substrate surfaces of the cooling substrate 12. The circuit portion 7 is provided with the first circuit portion 7*x* and the second circuit portion 7*y*. The first circuit portion 7*x* is provided with a first driver IC 8*x* which generates a drive waveform, a first circuit board 9*x* on which the first driver IC 8*x* is mounted, and a connector 9*a* which is disposed on the upper end of the first circuit board 9*x*. The second circuit portion 7*y* is provided with a second driver IC 8*y* which generates a driver waveform, a second circuit board 9*y* on which the second driver IC 8*y* is mounted, and a connector 9*a* which is disposed on the upper end of the second circuit board 9*y*. The first circuit board 9*x* is coupled and fixed to one of the substrate surfaces of the cooling substrate 12 with a heat release sheet 15*a* interposed therebetween. The second circuit board 9*y* is coupled and fixed to the other substrate surface of the cooling substrate 12 with a heat release sheet 15*b* interposed therebetween.

The head portion 2 has a structure having two head portions 2 of the second embodiment coupled to each other, wherein four pressure chambers 4*a*, 4*b*, 4*a*, and 4*b* are arranged in the direction perpendicular to the reference direction K and four pressure chamber arrays are arrayed in the reference direction K. The pressure chambers 4 in the respective arrays are displaced by a one-quarter pitch in the reference direction K. The head portion 2 includes, for example, a first head portion 2*x* having the same structure as the head portion 2 of the second embodiment and a second head portion 2*y* having the same structure as the first head portion 2*x* which are displaced by a one-quarter pitch in the reference direction K.

Alternatively, four pressure chambers 4 may be arranged in the direction perpendicular to the reference direction K on a single actuator substrate 2*a*, and four pressure chamber arrays may be arrayed in the reference direction K. In this case, a single cover plate 2*b* is disposed on the upper surface of the actuator substrate 2*a*, and a single nozzle plate 2*c* provided with four nozzle arrays is disposed on the lower surface of the actuator substrate 2*a*. Further, a flow path member 2*d* is disposed on the upper surface of the cover plate 2*b*. The actuator substrate 2*a*, the cover plate 2*b*, the nozzle plate 2*c*, and the flow path member 2*d* are integrally configured. The supply flow path 3 includes the first supply flow path 3*x* and the second supply flow path 3*y*. The first supply flow path 3*x* communicates with two of the pressure chamber arrays. The second supply flow path 3*y* communicates with the other two pressure chamber arrays. Flexible circuit boards (not illustrated) are disposed between the first circuit board 9*x* and the actuator substrate 2*a* and between the second circuit board 9*y* and the actuator substrate 2*a* so that drive waveforms generated by the first driver IC 8*x* and the second driver IC 8*y* can be supplied to the actuator substrate 2*a*.

The cooling substrate 12 of the cooling portion 10 is held by the supply port 13 and the discharge port 14 with a space from the base member 18. The supply port 13 includes a connection portion 13*a* through which liquid supplied from the outside flows in and divides the liquid to flow into the first supply flow path 3*x*, the second supply flow path 3*y*, and the cooling flow path 11. The discharge port 14 includes a connection portion 14*a* through which the liquid is discharged to the outside, and allows liquid flowing out of the first supply flow path 3*x*, liquid flowing out of the second supply flow path 3*y*, and liquid flowing out of the cooling flow path 11 to join together and discharges the joined liquid to the outside therefrom.

The supply port 13 includes a branch point Pb at which the liquid is divided to flow into the first supply flow path 3*x* and the second supply flow path 3*y* and a branch point Pb' at which the liquid is divided to flow into the cooling flow path 11, the branch point Pb' being located between the branch point Pb and the first supply flow path 3*x*. Similarly, the discharge port 14 includes a junction point Pg (not illustrated) at which the liquid flowing out of the first supply flow path 3*x* and the liquid flowing out of the second supply flow path 3*y* join together and a junction point Pg' (not illustrated) at which the liquid flowing out of the cooling flow path 11 joins the liquid flowing out of the first supply flow path 3*x*, the junction point Pg' being located between the junction point Pg and the first supply flow path 3*x*. A flow path resistance between the branch point Pb of the supply port 13 and the first supply flow path 3*x* differs from a flow path resistance between the branch point Pb and the second supply flow path 3*y*. The liquid is divided to flow into the cooling flow path 11 at the branch point Pb'. Similarly, a flow path resistance between the junction point Pg of the discharge port 14 and the first supply flow path 3*x* differs from a flow path resistance between the junction point Pg and the second supply flow path 3*y*. The liquid from the cooling flow path 11 joins the liquid from the first supply flow path 3*x* at the junction point Pg'. Thus, there is generated a difference in pressure between the liquid supplied to the first supply flow path 3*x* and the liquid supplied to the second supply flow path 3*y*. In view of this, an inner flow path R of the supply port 13 and an inner flow path S of the discharge port 14 should be designed so as to allow the pressure difference not to affect the ejection characteristics.

Although the branch point Pb and the junction point Pg are respectively located in the inner flow path R of the supply port 13 and the inner flow path S of the discharge port 14, the present invention is not limited to this configuration. The branch point Pb or the junction point Pg may be located in the cooling flow path 11, or may also be located inside the head portion 2.

Fourth Embodiment

Figure 5:
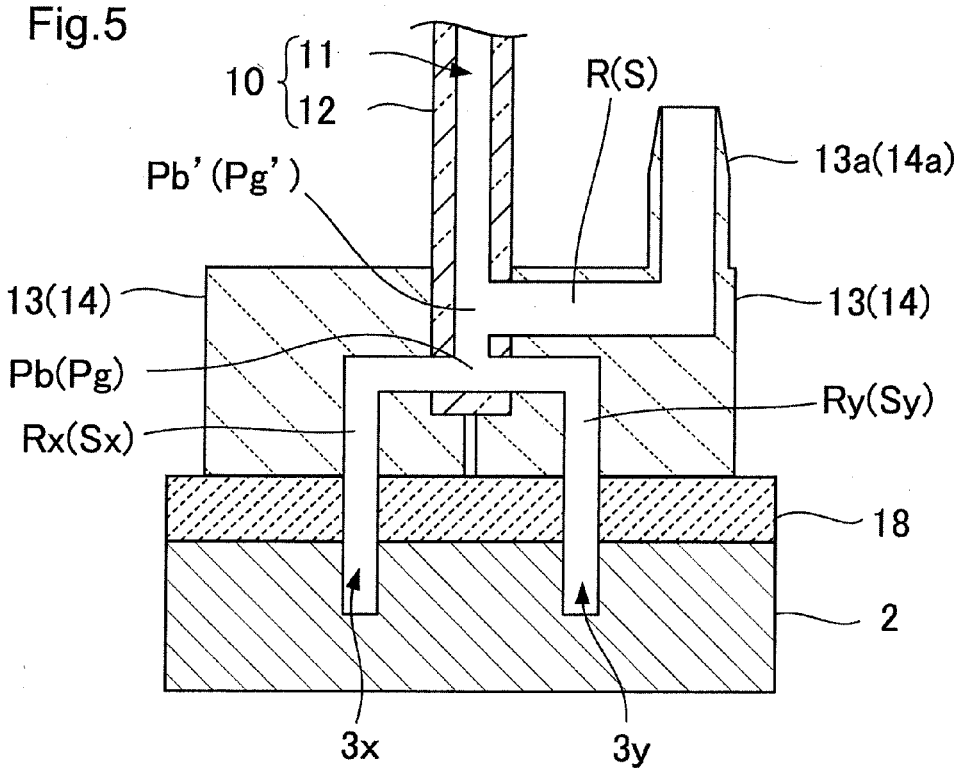
FIG. 5 is a schematic cross-sectional view for explaining inner flow paths of a liquid jet head according to a fourth embodiment of the present invention.

FIG. 5 is a schematic cross-sectional view for explaining inner flow paths of a liquid jet head 1 according to a fourth embodiment of the present invention. The fourth embodiment differs from the third embodiment in the configurations of inner flow paths R, Rx, and Ry of a supply port 13 and inner flow paths S, Sx, and Sy of a discharge port 14. The other configurations are the same as those of the third embodiment. Thus, hereinbelow, the differences from the third embodiment will be described, and description of the other configurations will be omitted. Identical elements or elements having identical functions will be designated by the same reference numerals.

As illustrated in FIG. 5, a head portion 2 is disposed on the lower part of a base member 18. The supply port 13 and the discharge port 14 are disposed on the upper part of the base member 18. A cooling portion 10 is held by the supply port 13 and the discharge port 14 with a space from the base member 18. The supply port 13 includes a connection portion 13*a* through which liquid supplied from the outside flows in. Similarly, the discharge port 14 includes a connection portion 14*a* through which the liquid is discharged to the outside.

The inner flow path R which allows liquid supplied from the outside to flow to the cooling substrate 12 is formed inside the supply port 13. A point at which the inner flow path R and a cooling flow path 11 communicate with each other constitutes a branch point Pb'. The liquid is divided to flow into the cooling flow path 11 and a flow path leading to the head portion 2 at the branch point Pb'. A branch point Pb is located on the flow path leading to the head portion 2. The flow path leading to the head portion 2 is divided into the inner flow path Rx which communicates with a first supply flow path 3*x* and the inner flow path Ry which communicates with a second supply flow path 3*y* at the branch point Pb. Similarly, the inner flow path S which allows the liquid to flow to the outside from the cooling substrate 12 is formed inside the discharge port 14. A point at which the cooling flow path 11 and the inner flow path S communicate with each other constitutes a junction point Pg'. Liquid flowing from the cooling flow path 11 and liquid flowing from a flow path leading from the head portion 2 join together at the junction point Pg'. A junction point Pg is located on the flow path leading from the head portion 2. The inner flow path Sx which communicates with the first supply flow path 3*x* and the inner flow path Sy which communicates with the second supply flow path 3*y* join together at the junction point Pg. Thus, the liquid supplied to the supply port 13 is divided to flow into the first supply flow path 3*x*, the second supply flow path 3*y*, and the cooling flow path 11. Similarly, the liquid flowing out of the first supply flow path 3*x*, the liquid flowing out of the second supply flow path 3*y*, and the liquid flowing out of the cooling flow path 11 join together, and the joined liquid is discharged through the discharge port 14.

A flow path resistance in the inner flow path Rx between the branch point Pb and the first supply flow path 3*x* is equal to a flow path resistance in the inner flow path Ry between the branch point Pb and the second supply flow path 3*y*. Similarly, a flow path resistance in the inner flow path Sx between the junction point Pg and the first supply flow path 3*x* is equal to a flow path resistance in the inner flow path Sy between the junction point Pg and the second supply flow path 3*y*. This decreases a difference in pressure between a pressure chamber communicating with the first supply flow path 3*x* and a pressure chamber communicating with the second supply flow path 3*y*. Thus, it is possible to equalize the ejection characteristics between ejection operations from the respective pressure chambers. The branch point Pb and the junction point Pg may be respectively located inside the supply port 13 and the discharge port 14 to make the flow path resistance in the inner flow path Rx equal to the flow path resistance in the inner flow path Ry and to make the flow path resistance in the inner flow path Sx equal to the flow path resistance in the inner flow path Sy.

Although the branch points Pb, Pb' and the junction point Pg, Pg' are located inside the cooling substrate 12 in the present embodiment, the present invention is not limited to this configuration. For example, the liquid flowing from the connection portion 13*a* may be directly guided to the head portion 2, and an inner flow path R having a branch point Pb on the head portion 2 and an inner flow path S having a junction point Pg on the head portion 2 may be formed to make the flow path resistance between the branch point Pb and the first supply flow path 3*x* equal to the flow path resistance between the branch point Pb and the second supply flow path 3*y* and to make the flow path resistance between the junction point Pg and the first supply flow path 3*x* equal to the flow path resistance between the junction point Pg and the second supply flow path 3*y*.

Fifth Embodiment

Figure 6:
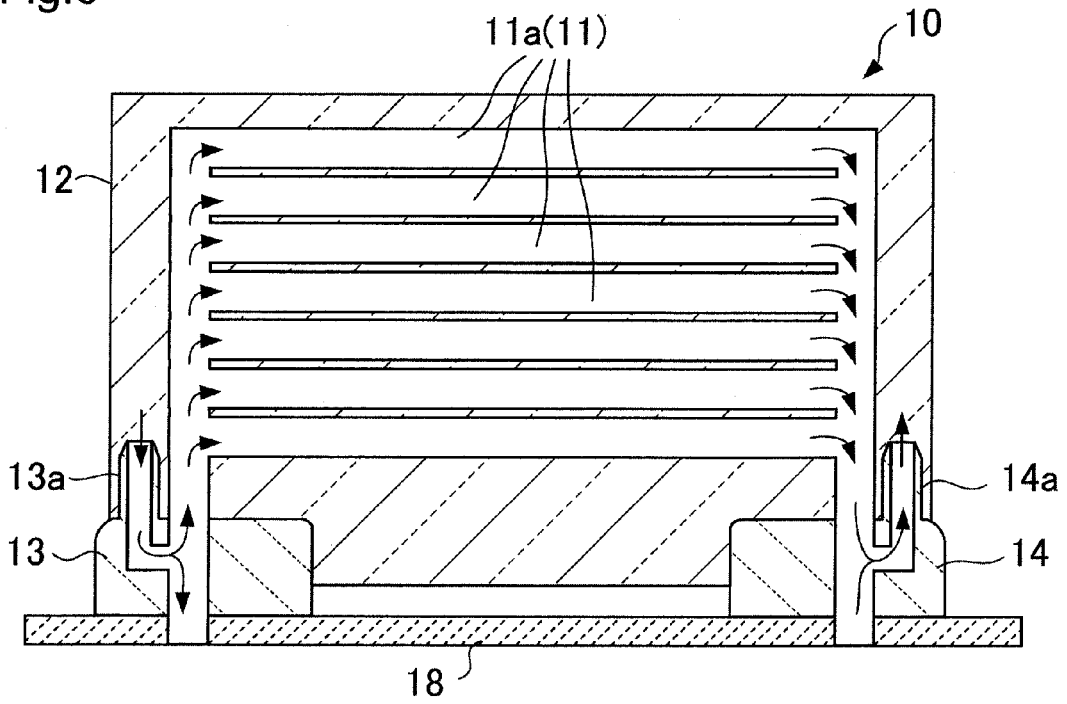
FIG. 6 is a schematic front view of a cooling portion used in a liquid jet head according to a fifth embodiment of the present invention.

FIG. 6 is a schematic front view of a cooling portion 10 used in a liquid jet head 1 according to a fifth embodiment of the present invention. The cooling portion 10 of the fifth embodiment differs from the cooling portions 10 of the first to fourth embodiments in that a cooling flow path 11 is divided into a plurality of flow paths. The other configurations are the same as those of the other embodiments. Identical elements or elements having identical functions will be designated by the same reference numerals.

As illustrated in FIG. 6, the cooling flow path 11 is divided into a plurality of flow paths 11*a* on the upstream side. The flow paths 11*a* join together on the downstream side. Accordingly, it is possible to suppress an increase in the flow path resistance to increase the flow path area, and to thereby improve the cooling efficiency.

Sixth Embodiment

Figure 7:
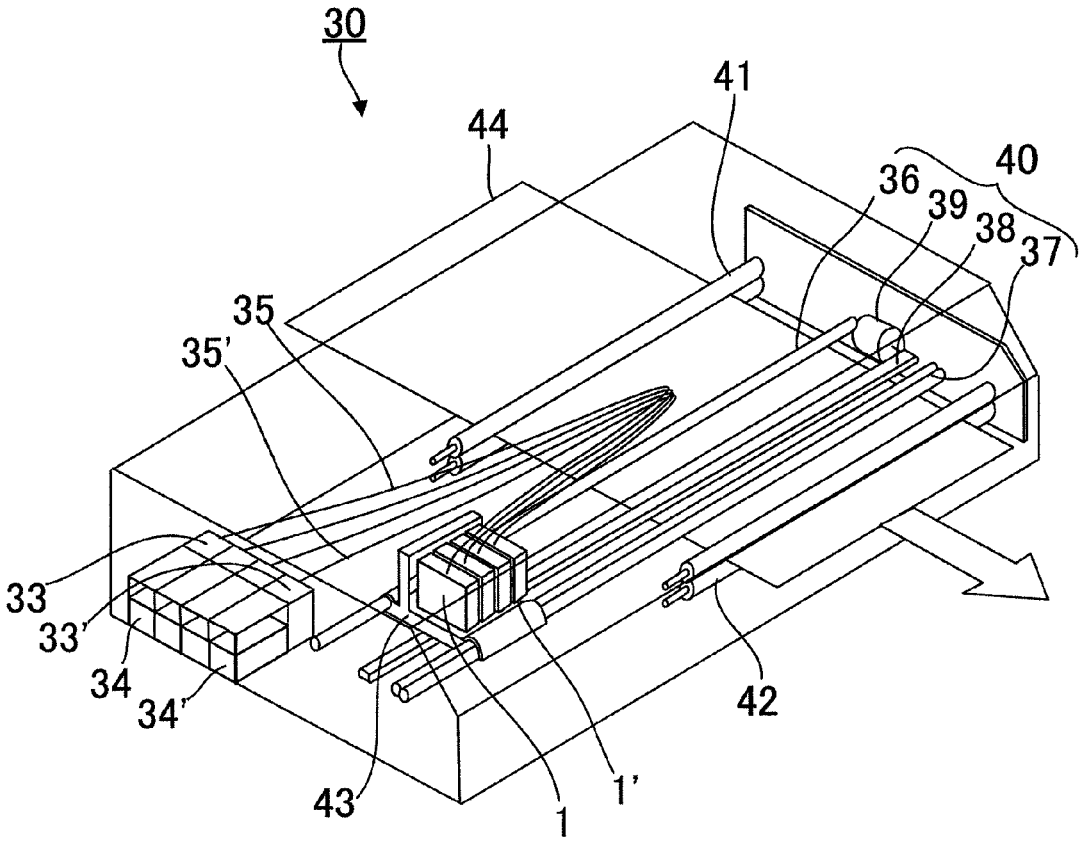
FIG. 7 is a schematic perspective view of a liquid jet apparatus according to a sixth embodiment of the present invention.
Figure 8:
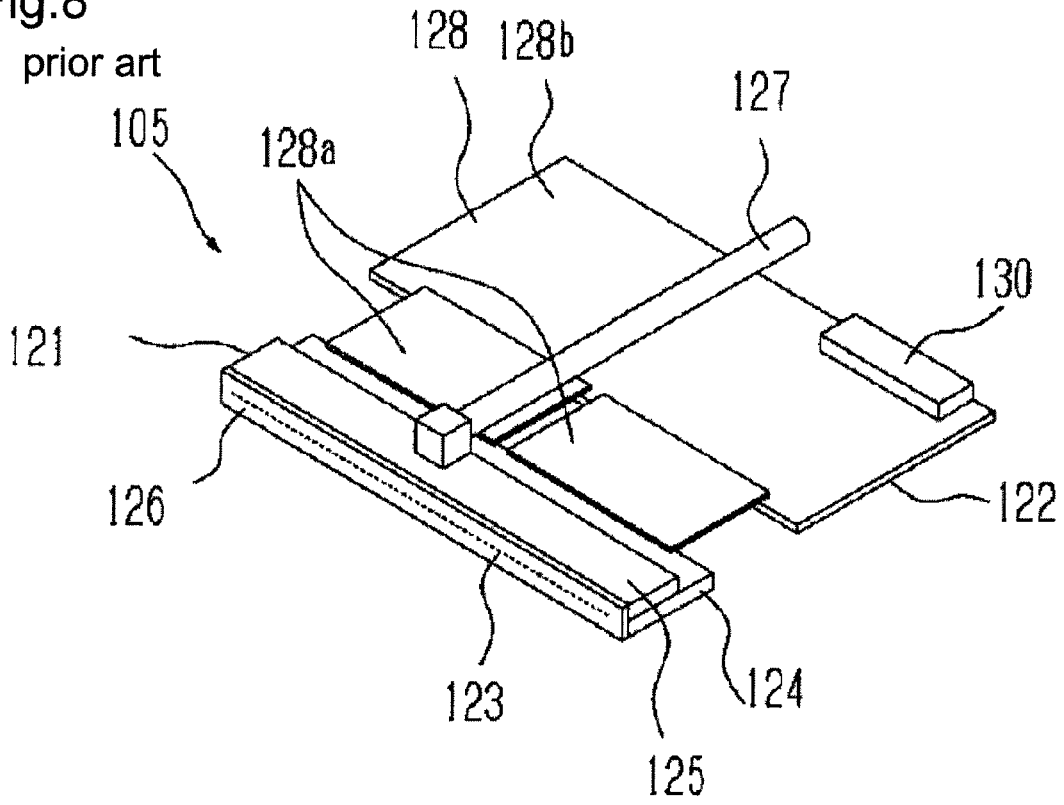
Fig.8 prior art
FIG. 8 is a perspective view of a conventionally known ink jet printer head.
Figure 9A:
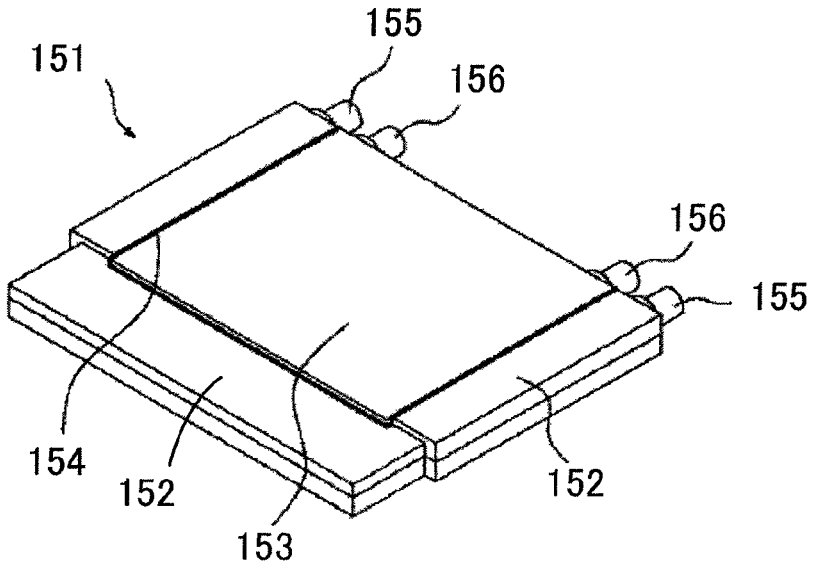
Fig.9A prior art
FIGS. 9A and 9B are explanatory diagrams of a temperature control base for the conventionally known ink jet printer head.
Figure 9B:
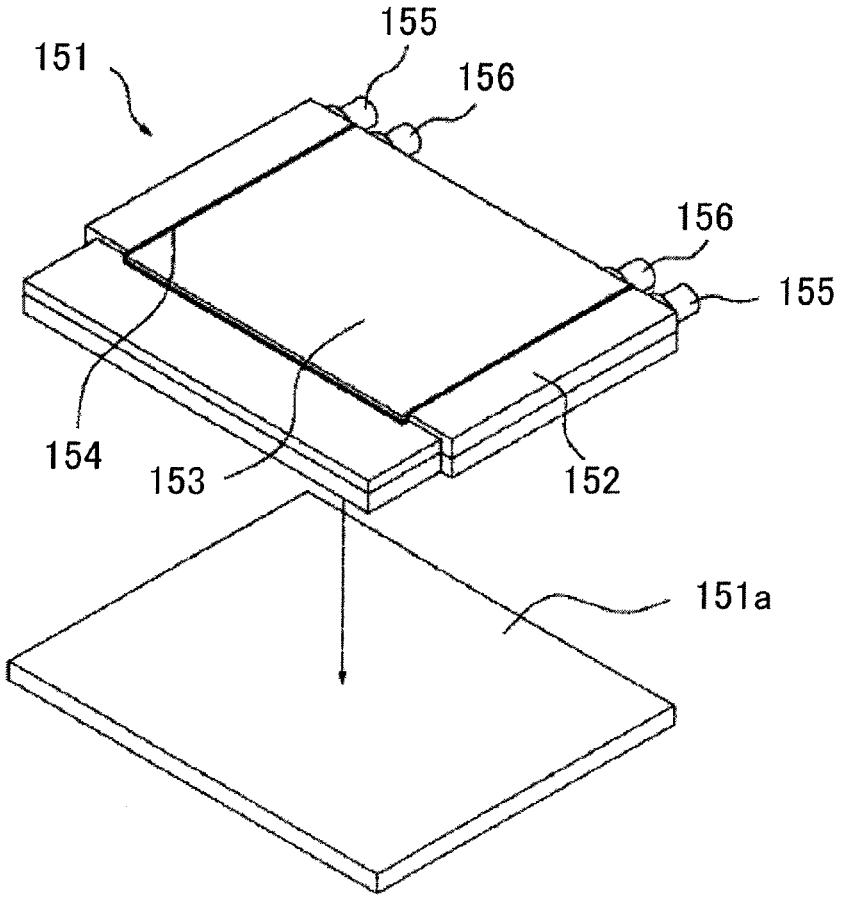
Fig.9B prior art

FIG. 7 is a schematic perspective view of a liquid jet apparatus 30 according to a sixth embodiment of the present invention. The liquid jet apparatus 30 is provided with a movement mechanism 40 which reciprocates liquid jet heads 1, 1', flow path portions 35, 35' which supply liquid to the liquid jet heads 1, 1' and discharge liquid from the liquid jet heads 1, 1', and liquid pumps 33, 33' and liquid tanks 34, 34' which communicate with the flow path portions 35, 35'. As the liquid pumps 33, 33', either or both of supply pumps which supply liquid to the flow path portions 35, 35' and discharge pumps which discharge liquid to components other than the flow path portions 35, 35' may be provided to circulate liquid. Further, a pressure sensor or a flow sensor (not illustrated) may be provided to control the flow rate of liquid. As each of the liquid jet heads 1, 1', any one of the liquid jet heads 1 of the first to fifth embodiments may be used. That is, the liquid jet head 1 is provided with the head portion 2 which ejects liquid droplets, the circuit portion 7 which supplies a drive waveform to the driver element of the head portion 2, and the cooling portion 10 which is coupled and fixed to the circuit portion 7. The cooling portion 10 performs cooling using the liquid for ejection. Thus, it is not necessary to connect the liquid jet heads 1, 1' to a flow path portion dedicated for cooling. Further, it is not necessary to provide a liquid pump dedicated for cooling the liquid jet heads 1, 1'.

The liquid jet apparatus 30 is provided with a pair of conveyance units 41, 42 which conveys a recording medium 44 such as paper in a main scanning direction, the liquid jet heads 1, 1' each of which jets liquid onto the recording medium 44, a carriage unit 43 on which the liquid jet head 1, 1' are placed, the liquid pumps 33, 33' which supply liquid stored in the liquid tanks 34, 34' to the flow path portions 35, 35' by pressing, and the movement mechanism 40 which moves the liquid jet heads 1, 1' in a sub-scanning direction that is perpendicular to the main scanning direction. A control unit (not illustrated) controls the liquid jet heads 1, 1', the movement mechanism 40, and the conveyance units 41, 42 to drive.

Each of the conveyance units 41, 42 extends in the sub-scanning direction, and includes a grid roller and a pinch roller which rotate with the roller surfaces thereof making contact with each other. The grid roller and the pinch roller are rotated around the respective shafts by a motor (not illustrated) to thereby convey the recording medium 44 which is sandwiched between the rollers in the main scanning direction. The movement mechanism 40 is provided with a pair of guide rails 36, 37 each of which extends in the sub-scanning direction, the carriage unit 43 which is slidable along the pair of guide rails 36, 37, an endless belt 38 to which the carriage unit 43 is coupled to move the carriage unit 43 in the sub-scanning direction, and a motor 39 which revolves the endless belt 38 through a pulley (not illustrated).

The plurality of liquid jet heads 1, 1' are placed on the carriage unit 43. The liquid jet heads 1, 1' eject, for example, four colors of liquid droplets: yellow, magenta, cyan, and black. Each of the liquid tanks 34, 34' stores therein liquid of the corresponding color, and supplies the stored liquid to each of the liquid jet heads 1, 1' through each of the liquid pumps 33, 33' and each of the flow path portions 35, 35'. Each of the liquid jet heads 1, 1' jets liquid droplets of the corresponding color in response to the drive waveform. Any patterns can be recorded on the recording medium 44 by controlling the timing of jetting liquid from the liquid jet heads 1, 1', the rotation of the motor 39 which drives the carriage unit 43, and the conveyance speed of the recording medium 44.

The liquid jet head 1 according to the present invention does not use liquid dedicated for cooling other than the liquid for liquid droplet ejection in the head portion 2. Thus, it is not necessary to dispose a tube for cooling liquid between the liquid jet heads 1, 1' and the liquid pumps 33, 33'. This makes the placement of the liquid jet head 1 easy and also simplifies the configuration of the liquid jet apparatus 30. In the liquid jet apparatus 30 of the present embodiment, the movement mechanism 40 moves the carriage unit 43 and the recording medium 44 to perform recording. However, instead of this, the liquid jet apparatus may have a configuration in which a carriage unit is fixed, and a movement mechanism two-dimensionally moves a recording medium to perform recording. That is, the movement mechanism may have any configuration as long as it relatively moves the liquid jet head and a recording medium.

What is claimed is:

1. A liquid jet head comprising:

a head portion including a supply flow path configured to allow liquid supplied from the outside to flow therethrough, a pressure chamber communicating with the supply flow path, a driver element configured to drive the pressure chamber, and a nozzle communicating with the pressure chamber, the head portion being configured to eject liquid droplets through the nozzle;

a circuit portion configured to supply a drive waveform to the driver element;

a cooling portion including a cooling flow path configured to allow the liquid to flow therethrough, the cooling portion being coupled and fixed to the circuit portion, and the cooling flow path communicating with the supply flow path and the liquid flows through the supply flow path and through the cooling flow path in parallel; and a supply port configured to allow the liquid supplied from the outside to flow in therethrough, and a discharge port configured to discharge the liquid to the outside therethrough, wherein the liquid flowing into the supply port is divided to flow into the supply flow path and the cooling flow path, and the liquid flowing out of the supply flow path and the liquid flowing out of the cooling flow path join together and the joined liquid is discharged to the outside through the discharge port.

2. The liquid jet head according to claim 1, wherein the supply flow path includes a first supply flow path and a second supply flow path, the liquid flowing into the supply port is divided to flow into the first supply flow path, the second supply flow path, and the cooling flow path, and the liquid flowing out of the first supply flow path, the liquid flowing out of the second supply flow path, and the liquid flowing out of the cooling flow path join together and the joined liquid is discharged to the outside through the discharge port.

3. The liquid jet head according to claim 2, further comprising a branch point at which the liquid is divided to flow into the first supply flow path and the second supply flow path, wherein a flow path resistance between the branch point and the first supply flow path is equal to a flow path resistance between the branch point and the second supply flow path.

4. The liquid jet head according to claim 2, further comprising a junction point at which the liquid flowing out of the first supply flow path and the liquid flowing out of the second supply flow path join together, wherein a flow path resistance between the junction point and the first supply flow path is equal to a flow path resistance between the junction point and the second supply flow path.

5. The liquid jet head according to claim 1, wherein the circuit portion includes a driver IC configured to generate the drive waveform and a circuit board on which the driver IC is mounted, the cooling portion includes a cooling substrate having the cooling flow path formed inside thereof, and the circuit board and the cooling substrate are coupled and fixed to each other with substrate surfaces facing each other.

6. The liquid jet head according to claim 5, wherein the circuit board and the cooling substrate are coupled and fixed to each other with a heat release sheet interposed therebetween.

7. The liquid jet head according to claim 5, wherein the circuit board includes a first circuit board and a second circuit board, the first circuit board is coupled and fixed to one substrate surface of the cooling substrate, and the second circuit board is coupled and fixed to the other substrate surface of the cooling substrate.

8. The liquid jet head according to claim 5, wherein the cooling flow path has a cross-sectional shape in which the width in a direction parallel to the substrate surfaces of the cooling substrate is wider than the width in a direction perpendicular to the substrate surfaces of the cooling substrate.

9. The liquid jet head according to claim 5, wherein the cooling flow path meanders within a plane parallel to the substrate surfaces of the cooling substrate.

10. The liquid jet head according to claim 5, wherein the driver IC is disposed opposite to the cooling flow path.

11. A liquid jet apparatus comprising:

the liquid jet head according to claim 1;

a movement mechanism configured to relatively move the liquid jet head and a recording medium;

a liquid supply tube configured to supply the liquid to the liquid jet head; and a liquid tank configured to supply the liquid to the liquid supply tube.

12. A liquid jet head comprising:

a head portion including a supply flow path configured to allow liquid supplied from the outside to flow therethrough, a pressure chamber communicating with the supply flow path, a driver element configured to drive the pressure chamber, and a nozzle communicating with the pressure chamber, the head portion being configured to eject liquid droplets through the nozzle;

a circuit portion configured to supply a drive waveform to the driver element; and a cooling portion including a cooling flow path configured to allow the liquid to flow therethrough, the cooling portion being coupled and fixed to the circuit portion, wherein the cooling flow path communicates with the supply flow path and the liquid flows through the supply flow path and through the cooling flow path in parallel; and the cooling flow path is divided into a plurality of flow paths on an upstream side and the plurality of flow paths join together on a downstream side.

* * * * *